US006718729B2

(12) United States Patent
Manley

(10) Patent No.: US 6,718,729 B2
(45) Date of Patent: Apr. 13, 2004

(54) CUSHIONING CONVERSION SYSTEM WITH DUNNAGE PAD TRANSFER MECHANISM

(76) Inventor: Thomas E. Manley, 7105 Hayes Blvd., Mentor, OH (US) 44060

( * ) Notice: Subject to any disclaimer, the term of this patent is extended or adjusted under 35 U.S.C. 154(b) by 35 days.

(21) Appl. No.: 10/032,509

(22) Filed: Oct. 19, 2001

(65) Prior Publication Data

US 2002/0107129 A1 Aug. 8, 2002

Related U.S. Application Data

(60) Provisional application No. 60/242,403, filed on Oct. 20, 2000.

(51) Int. Cl.[7] ..... B65B 1/06

(52) U.S. Cl. ..... 53/247; 53/472; 53/255; 493/8; 493/12; 493/29

(58) Field of Search ..... 53/472, 247, 248, 53/249, 255; 493/8, 12, 29; 414/798, 798.1; 221/12, 290, 194

(56) References Cited

U.S. PATENT DOCUMENTS

| | | | | |
|---|---|---|---|---|
| 2,956,384 A | | 10/1960 | Underwood | |
| 3,014,599 A | | 12/1961 | Lawrence et al. | |
| 3,238,692 A | * | 3/1966 | Montuori | 53/451 |
| 3,658,036 A | * | 4/1972 | Caracappa | 119/51.13 |
| 3,730,386 A | * | 5/1973 | Monsees | 221/7 |
| 3,848,395 A | * | 11/1974 | Totten | 53/473 |
| 3,864,891 A | | 2/1975 | Piereder | |
| 4,026,198 A | | 5/1977 | Ottaviano | |
| 4,085,662 A | | 4/1978 | Ottaviano | |
| 4,109,040 A | | 8/1978 | Ottaviano | |
| 4,138,835 A | | 2/1979 | Takayanagi et al. | |
| 4,237,776 A | | 12/1980 | Ottaviano | |
| 4,300,420 A | | 11/1981 | Haenni | |
| 4,405,186 A | | 9/1983 | Sandberg et al. | |
| 4,457,194 A | | 7/1984 | Mally | |

(List continued on next page.)

FOREIGN PATENT DOCUMENTS

| | | |
|---|---|---|
| EP | 0 485 628 A1 | 5/1992 |
| WO | 95/13914 | 5/1995 |
| WO | 96/37361 | 11/1996 |
| WO | 96/40495 | 12/1996 |
| WO | WO 98/04402 | 2/1999 |
| WO | WO 99/14033 | 3/1999 |

OTHER PUBLICATIONS

International Search Report from Ser. No. PCT/US01/49867, Filing Date Oct. 19, 2001.

U.S. patent application Ser. No. 09/156,109, Simmons, Jr. et al., filed Sep. 18, 1998.

*Primary Examiner*—Stephen F. Gerrity
*Assistant Examiner*—Hemant M. Desai
(74) *Attorney, Agent, or Firm*—Renner, Otto, Boisselle & Sklar, LLP

(57) ABSTRACT

A cushioning conversion system and method for transferring a dunnage pad are disclosed. The conversion system includes a cushioning conversion machine and a pad support. The conversion machine produces cushioning dunnage pads and discharges the pads in a predetermined discharge direction. A pad support is movable between a pad receiving position and a pad discharge position. In the pad receiving position, the pad support is oriented relative to the conversion machine to receive thereon dunnage pads discharged from the conversion machine in the discharge direction. In the pad discharge position, the pad support is tilted relative to horizontal for discharge of the dunnage pad from the pad support.

27 Claims, 5 Drawing Sheets

U.S. PATENT DOCUMENTS

| | | | | | |
|---|---|---|---|---|---|
| 4,557,716 | A | | 12/1985 | Ottaviano | |
| 4,633,653 | A | | 1/1987 | Roberts et al. | |
| 4,650,456 | A | | 3/1987 | Armington | |
| 4,696,464 | A | | 9/1987 | Gammerler | |
| 4,717,613 | A | | 1/1988 | Ottaviano | |
| 4,750,896 | A | | 6/1988 | Komaransky et al. | |
| 4,890,753 | A | | 1/1990 | Duryee et al. | |
| 4,968,291 | A | | 11/1990 | Baldacci et al. | |
| 5,109,799 | A | * | 5/1992 | Lader | 119/51.13 |
| 5,123,889 | A | | 6/1992 | Armington et al. | |
| 5,185,984 | A | | 2/1993 | Tisma | |
| 5,207,350 | A | * | 5/1993 | Spanton | 221/105 |
| 5,322,477 | A | | 6/1994 | Armington et al. | |
| 5,363,729 | A | | 11/1994 | Ogasawara | |
| 5,379,569 | A | | 1/1995 | Mueller | |
| 5,452,985 | A | * | 9/1995 | Roch et al. | 414/798.2 |
| 5,520,143 | A | * | 5/1996 | Duin | 119/51.13 |
| 5,542,232 | A | | 8/1996 | Beierlorzer | 53/117 |
| 5,611,193 | A | | 3/1997 | Farrelly | |
| 5,692,362 | A | | 12/1997 | Hoyland | |
| 5,778,631 | A | | 7/1998 | Simmons | |
| 5,782,065 | A | | 7/1998 | Gaebele | |
| 5,829,231 | A | | 11/1998 | Harding et al. | |
| 5,868,657 | A | | 2/1999 | Simmons | |
| 5,989,176 | A | | 11/1999 | Ratzel et al. | 493/464 |
| 6,185,915 | B1 | * | 2/2001 | Chang | 53/568 |
| 6,240,705 | B1 | * | 6/2001 | Simmons et al. | 53/237 |
| 6,421,985 | B1 | * | 7/2002 | Simmons et al. | 53/472 |

* cited by examiner

CUSHIONING CONVERSION SYSTEM WITH DUNNAGE PAD TRANSFER MECHANISM

RELATED APPLICATION DATA

This application claims priority benefit under 35 U.S.C. 119(e) of U.S. Provisional Application No. 60/242,403, entitled "DUNNAGE PAD TRANSFER MECHANISM FOR USE WITH A CUSHIONING CONVERSION MACHINE," filed Oct. 20, 2000.

FIELD OF THE INVENTION

This invention relates generally to a cushioning conversion system and, more particularly, to a dunnage pad transfer mechanism for use with a cushioning conversion machine in a packaging system.

BACKGROUND

In the cushioning conversion art a cushioning conversion machine, or converter, is used to convert sheet stock material, such as paper in multi-ply form, into low-density cushioning products, or dunnage pads. The dunnage pads are discharged in a predetermined discharge direction through an exit chute of the conversion machine.

Typically, the dunnage pads are discharged to a transitional zone and then, at the appropriate time, inserted into a container for cushioning purposes. A variety of arrangements have been used as transitional zones in packaging systems, such as the arrangement disclosed in U.S. Pat. No. 5,542,232. This patent is assigned to the assignee of the present invention and the entire disclosure is hereby incorporated herein by reference.

In U.S. Pat. No. 5,542,232, there is disclosed a packaging system including a conversion machine and a slide positioned adjacent to the machine. The conversion machine includes a frame and conversion assemblies that are mounted to the frame and create cushioning dunnage products commonly referred to as pads. The conversion machine has an outlet in the form of an exit chute through which the cushioning products are discharged onto the slide in a predetermined discharged direction. The slide has a smooth sloped surface with a top portion positioned proximate to the machine's exit chute so that the discharged cushioning products will be deposited thereon. The smooth sloped surface has a pitch angle which is sufficient to ensure that cushioning products placed on the top portion of the surface will slide in a predetermined slide direction. The smooth sloped surface is oriented relative to the machine in such a manner that the slide direction is substantially perpendicular to the discharge direction. This geometric relationship allows the cushioning dunnage pads to stack in a consecutive side by side arrangement and thereby present the pads in a sequential fashion.

The cushioning dunnage pads discharged from the conversion machine and deposited on the smooth sloped surface heretofore have had a tendency to fall obliquely, or tilt, as the dunnage pads slide down the slide. As the dunnage pads accumulate on the slide, some may become disoriented or skewed such that they do not align in an orderly fashion. This skewing of the dunnage pads interrupts the smooth flow of a packaging process, and consequently increases packing time. The aforementioned problems become more pronounced with smaller size pads. It would be desirable to provide a packaging system which consistently presents the dunnage pads in a more orderly and thus more ergonomically friendly manner.

SUMMARY OF THE INVENTION

The present invention provides a dunnage pad transfer mechanism for a cushioning conversion machine. The transfer mechanism includes a pad support for receiving and supporting a pad as it exits from the cushioning conversion machine. Thereafter the pad support is tilted in a controlled manner to transfer the pad onto a transitional surface, such as a slide surface, for further transfer, such as to a pad staging area where the dunnage pad is available for pickup by a packer.

According to one aspect of the invention, a cushioning conversion system comprises a cushioning conversion machine and a pad support located adjacent the outlet of the conversion machine. The conversion machine produces cushioning dunnage pads and discharges the pads on to the pad support in a predetermined discharge direction. The pad support is movable between a pad receiving position and a pad discharge position. In the pad receiving position, the pad support is oriented relative to the conversion machine to receive thereon and support dunnage pads discharged from the conversion machine in the discharge direction. In the pad discharge position, the pad support is tilted relative to horizontal for discharge of the dunnage pad from the pad support.

In a preferred embodiment, the dunnage pad slips onto a slide for further passage by gravity to a staging area where the dunnage pad is presented for pickup by a packer. As is also preferred, the pad support pivots about an axis parallel to the discharge direction of the pads exiting the conversion machine.

According to another aspect of the invention, a method of providing a dunnage pad onto a transitional surface comprises the steps of using a cushioning conversion machine to convert sheet stock material into a dunnage pad, discharging the dunnage pad from the conversion machine onto a pad support, and tilting the pad support to discharge the dunnage pad therefrom and onto the transitional surface.

The invention also provides a dunnage pad delivery system for positioning at the outlet of a cushioning conversion machine. The pad delivery system comprises a pad support movable between a pad receiving position and a pad discharge position, and a transitional slide adjacent the pad support for receiving pads therefrom when the pad support is tilted from its pad receiving position to its pad discharge position.

The foregoing and other features of the invention are more fully described and particularly pointed out in the claims. The following descriptive annexed drawings set forth in detail one illustrated embodiment, this embodiment being indicative of but one of the various ways in which the principles of the invention may be employed.

DETAILED DESCRIPTION OF THE INVENTION

Figure 1:
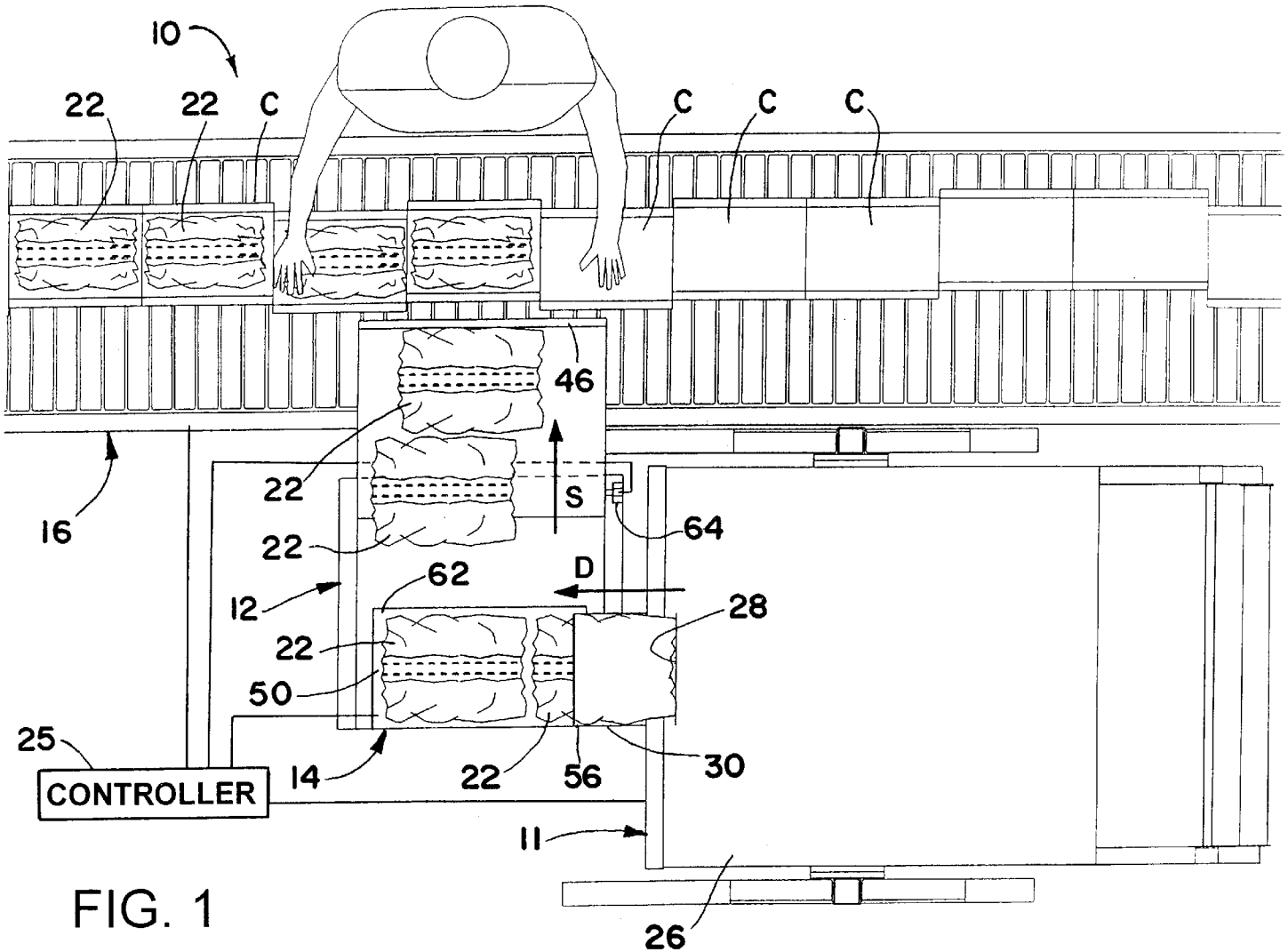
FIG. 1 is a top view of a packaging system according to the present invention, the system including a conversion machine, a transitional member in the form of a slide, and a dunnage pad transfer mechanism.
Figure 2:
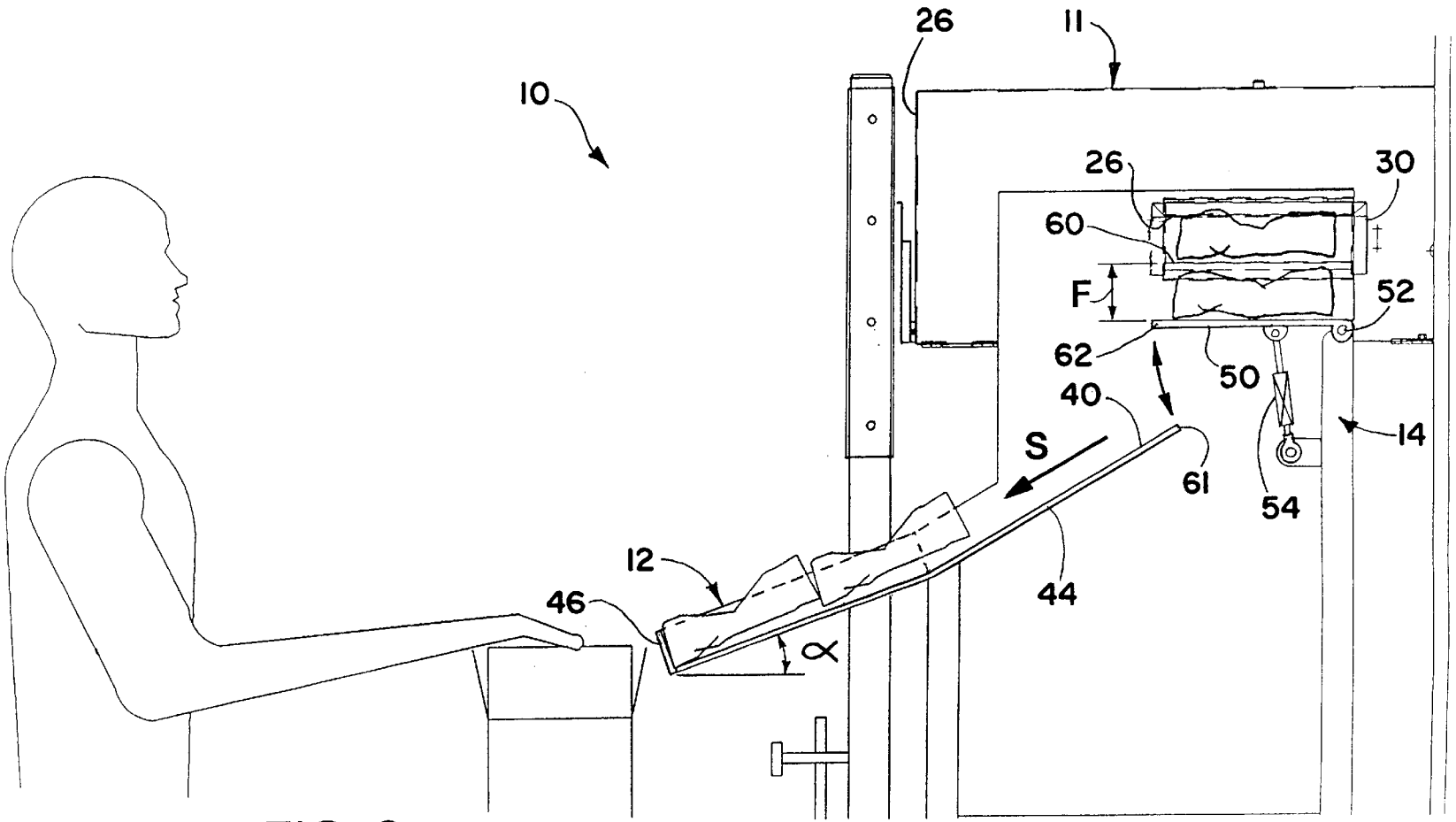
FIG. 2 is an end view of the packaging system of FIG. 1.

Referring now to the drawings in detail, a packaging system 10 according to the present invention is shown in FIGS. 1 and 2. The packaging system 10 includes a cushioning conversion machine 11, a transitional member 12, preferably a slide, which is positioned adjacent to the machine 11, and a dunnage pad transfer mechanism 14 which transfers a dunnage pad 22 produced by the conversion machine 11 to the slide 12 in a controlled manner. As is described in greater detail below, the dunnage pad transfer mechanism 14 receives the dunnage pad 22 from the conversion machine 11 in a discharge direction D and subsequently discharges the dunnage pad 22 onto the slide 12 in a slide direction S. In so doing, the transfer mechanism 14 separates and makes independent the movement of the dunnage pad 22 in the discharge direction D and the movement of the dunnage pad 22 in the slide direction S. This controlled movement of the dunnage pad 22 avoids problems that may arise from random movement of the dunnage pad such as, for example, the above mentioned problem of the dunnage pad tilting or falling obliquely onto the slide.

As is further seen in FIGS. 1 and 2, the packaging system 10 may also include a container conveyer 24 which conveys containers C in proximity to the bottom portion of the slide 12, enabling an operator to pick a dunnage pad 22 from the slide 12 and place the dunnage pad 22 into a container C. Also, a controller 25 (shown in FIG. 1 only) may be provided to control the packaging system 10.

The illustrated conversion machine 11 may be any conversion machine which converts sheet stock material into cushioning products or dunnage pads 22 of a desired length, such as the conversion machine shown and described in the above noted U.S. Pat. No. 5,542,232. The conversion machine 11 draws sheet stock material from a supply thereof to a forming assembly in a housing 26 of the machine 11. The forming assembly causes inward turning of the lateral edges of the sheet stock material to form a continuous strip having lateral pillow like portions and a central band. A gear assembly of the machine 11 pulls the stock material downstream through the machine 11 and also connects (for example, by coining and/or perforating) the central band of the continuous strip to form a connected strip. As the connected strip travels downstream from the gear assembly, a severing assembly severs the connected strip into a cushioning dunnage pad 22 of a desired length.

The dunnage pad 22 is discharged through an exit opening 28 of the conversion machine 11. In the illustrated embodiment, the dunnage pad 22 is discharged through a discharge chute 30, where the dunnage pad 22 may remain until a succeeding dunnage pad 22 pushes the dunnage pad 22 from the discharge chute 30 to the dunnage pad transfer mechanism 14; that is, the dunnage pad 22 is pushed out while a new dunnage pad is being formed. A pre-feed of a prescribed length may be used to push the dunnage pad out of the discharge chute 30. For example, if a 20 inch pad is to be produced, the conversion machine 11 may be operated until a 20 inch pad is produced and severed to form a first dunnage pad. Then, the conversion machine 11 may be operated to make the initial six (6) inches of the next dunnage pad, this pushing the first dunnage pad out of the chute 30. When another (i.e., second) 20 inch dunnage pad is to be made, the remaining 14 inches of the next dunnage pad is produced to form a second dunnage pad that is then severed and followed by a six (6) inch pre-feed of the next pad.

It is noted that longer dunnage pads may draw themselves out of the discharge chute 30 so that a push from a succeeding dunnage pad is not necessary. Also, in some applications a pad transferring assembly may be used to frictionally engage and transfer a dunnage pad to the pad transfer mechanism 14. An exemplary pad transferring assembly is shown and described in the above noted U.S. Pat. No. 5,542,232. The dunnage pad transfer mechanism 14, which is described in greater detail below, transfers the dunnage pad 22 to the slide 12.

In the illustrated embodiment, the slide 12, which includes a smooth sloped surface 40, forms at its lower end a transitional zone where one or more dunnage pads may be stored or queued up. It is noted that other forms of transitional zones may be used in conjunction with the packaging system, such as, for example, receptacles, conveyors, etc. Also, although the illustrated slide 12 is shown accommodating two dunnage pads 22, the present invention contemplates accommodation of one or more dunnage pads, as desired, and slides of different lengths for different applications.

To optimize the "smoothness" of the sloped surface 40, the slide 12 may be made of a material or have a surface formed from a material having a low coefficient of friction with respect to the dunnage pad 22, such that the dunnage pad 22 will slide substantially frictionlessly down the sloped surface 40. Such a material may be, for example, UHMW plastic, stainless steel with a PTFE coating, or #2B finish stainless steel, which is annealed, pickled and bright cold rolled. Reference may be had to the noted U.S. Pat. No. 5,542,232, for further details concerning the slide 12.

In the illustrated embodiment, the sloped surface 40 has a pitch angle $\alpha$ at a lower end portion and a slightly steeper pitch angle at an upper portion thereof, the angles being selected to ensure that a dunnage pad 22 deposited thereon will slide in the slide direction S (see FIG. 2) to the lower portion of the slide where the pad is staged for pickup by a packer. Here, the pitch angle alpha is about 25 to 30 degrees, for example.

The sloped surface 40 is oriented relative to the machine 11 in such a manner that the slide direction S is substantially perpendicular to the discharge direction D (FIG. 1). Additionally, the sloped surface 40 is substantially parallel to the discharge direction D.

As is shown in FIG. 2, the slide 12 includes a bottom wall 44, the top surface of which is the smooth sloped surface 40, and an end wall 46 providing a stop at the bottom end of the slide and against which a dunnage pad 22 moving down the slide 12 will stop, while any succeeding pads will queue up, or stack side-by-side on the slide 12. It will, of course, be appreciated that the slide 12 could be otherwise inclined relative to the discharge direction D of the machine 11, providing different controlled slide paths away from the dunnage pad transfer mechanism 14.

The dunnage pad transfer mechanism 14 includes a pad support 50, which is mounted for tilting movement at pivot pin 52, and an actuator 54 which pivotally moves the pad support 50 about the pivot pin 52. It will be appreciated by those skilled in the art that the pad support 50 may be mounted otherwise for tilting (rotational or swinging) movement, either to the machine or to a suitable support structure that may be mounted to the machine or supported independently of the machine, as desired. The pad support 50 is generally a tray or other support member preferably having a low friction, planar top surface such as that described above with respect to the slide 12. The pad support 50 is operative to support the dunnage pad 22 from underneath as a dunnage pad is being formed, and then to discharge the dunnage pad 22 when the pad support 50 is pivoted to an inclined position, as is further described below. The actuator 54 may be any suitable device, for example, a solenoid or a pneumatically or hydraulically driven actuator, which is operative to tilt the pad support 50 between the pad receiving position (FIGS. 2, 3A, 3C and 3D) and the pad discharge position (FIG. 3B).

The pad support 50 is located adjacent an outlet end 56 (FIG. 1) of the discharge chute 30 and sufficiently proximate thereto so that the dunnage pads 22 discharged from the chute 30 will be deposited on the pad support 50. More particularly, as is seen in FIG. 2, when the pad support 50 is in its pad receiving position, it is substantially horizontal and lies in a plane substantially parallel to a bottom plane or wall 60 of the machine's discharge chute 30. When the pad support 50 is in its pad discharge, or inclined, position, the pad support 50 is substantially parallel to and preferably substantially coplanar with the bottom wall 44 of the slide 12 at the upper end of the slide 12. If desired, a distal end 62 of the pad support 50 may slightly overlap the sloped surface 40 of the slide 12 when tilted to its discharge position.

For some applications, and as shown in FIG. 2, the pad support 50, when it is in its pad receiving position, may be vertically spaced (offset) below the bottom plane 60 of the chute 30 (a distance, F, in FIG. 2). This spacing F may be greater than the height of the dunnage pad 22 or otherwise selected so that, in operation, as the dunnage pad 22 is emitted from the discharge chute 30, the dunnage pad 22 falls downward by gravity and clears itself of the next or succeeding dunnage pad (i.e., the dunnage pad trailing therebehind) in the discharge chute 30. Accordingly, as the pad support 50 is pivoted by the actuator 54 to its discharge position, the trailing end of the dunnage pad 22 thereon is clear of the leading end of the next or succeeding dunnage pad, thus preventing the trailing end of the dunnage pad 22 from "catching" the leading end of the succeeding dunnage pad and possibly skewing the dunnage pad 22 when the dunnage pad 22 is discharged from the pad support 50. In this instance, the above-described pre-feed feature would be superfluous. Of course, as is described below, the pad support 50 may lie in the same plane as the bottom plane 60 of the discharge chute 30, in which case the pre-feed feature would be advantageous.

In the illustrated embodiment, the operation of the conversion machine 11 and transfer mechanism 14 are coordinated by the controller 25, although it will be appreciated that these components may be controlled manually and/or independently of each other. The controller 25 is in communication with a pad sensor 64 positioned about one and one half pad widths up from the end wall 46 of the slide 12 (FIG. 1), so as to provide for queuing of two pads in the illustrated embodiment. The pad sensor 64 detects whether there is a dunnage pad 22 on the slide 12 two pads up from the end wall 46 thereof (i.e., "the second pad position"). If a dunnage pad 22 is detected in the second pad position, the conversion machine 11 stops the conversion process. If there is no dunnage pad 22 detected in the second pad position, the conversion machines is operated to produce a dunnage pad 22 which is then discharged by the dunnage pad transfer mechanism 14 onto the slide.

It will be appreciated by those skilled in the art that the position of the pad sensor 64 relative to the end wall 46 of the slide 12 may be adjusted for queuing up one, two (as in the illustrated embodiment), three or any number of dunnage pads 22 for stowage on the slide 12. Also, other sensing arrangements may be employed if desired.

Figure 3A:
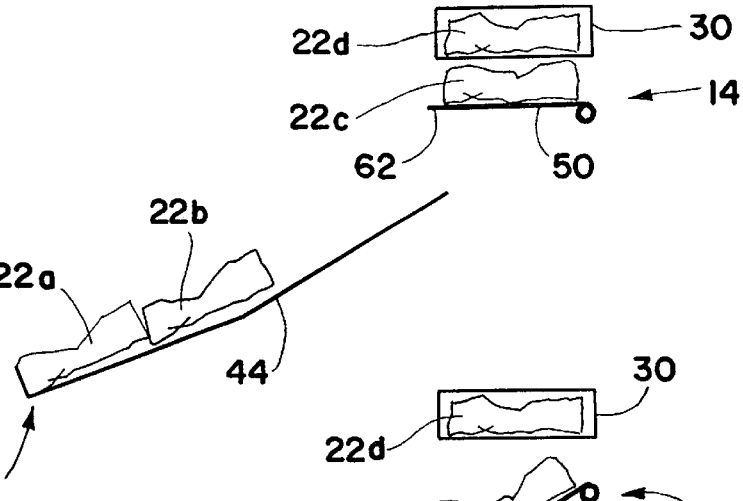
FIGS. 3A–3D are schematic end views sequentially showing the manner by which a dunnage pad is transferred from the cushioning conversion machine to the slide.
Figure 3B:
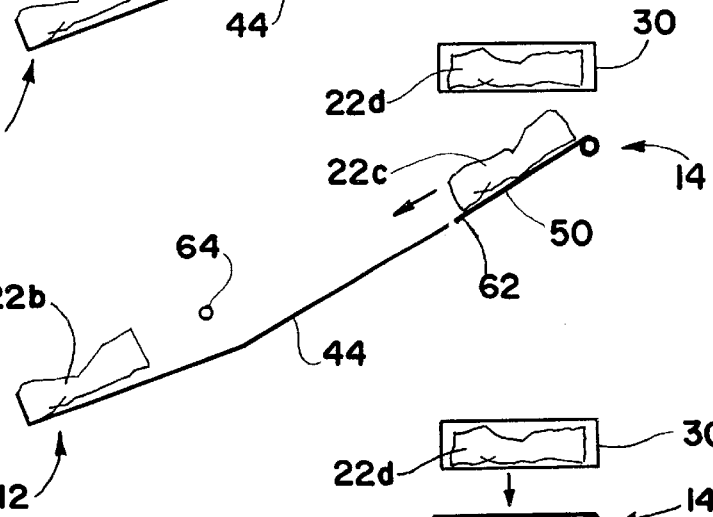

FIGS. 3A–3D sequentially illustrate in greater detail the manner by which a dunnage pad 22 is transferred by the transfer mechanism 14 from the conversion machine 11 to the slide 12. In FIG. 3A, dunnage pad 22*a* is supported in the bottom portion of the slide 12, dunnage pad 22*b* is supported in the second pad position of the slide 12, dunnage pad 22*c* is supported in the receiving, or horizontal, position by the pad support 50, and dunnage pad 22*d* is supported by the discharge chute 30. The pad sensor 64 (not shown in FIG. 3A) detects the presence of the dunnage pad 22*b* in the second pad position and, accordingly, the controller 25 places the conversion machine 11 in standby mode or otherwise stops the conversion machine 11.

In FIG. 3B, the dunnage pad 22*a* has been removed from the bottom portion of the slide 12 and the dunnage pad 22*b* has slid into its place. The pad sensor 64 detects the absence of a dunnage pad 22 in the second pad position and instructs the dunnage pad transfer mechanism 14 via the controller 25 to discharge the dunnage pad 22*c* thereto. Thus, as is seen in FIG. 3B, the pad support 50 is pivoted downwardly by the actuator 54 (FIG. 2) to its inclined, or pad discharge, position thereby to deposit the dunnage pad 22*c* on the bottom wall 44 of the slide 12.

Figure 3C:
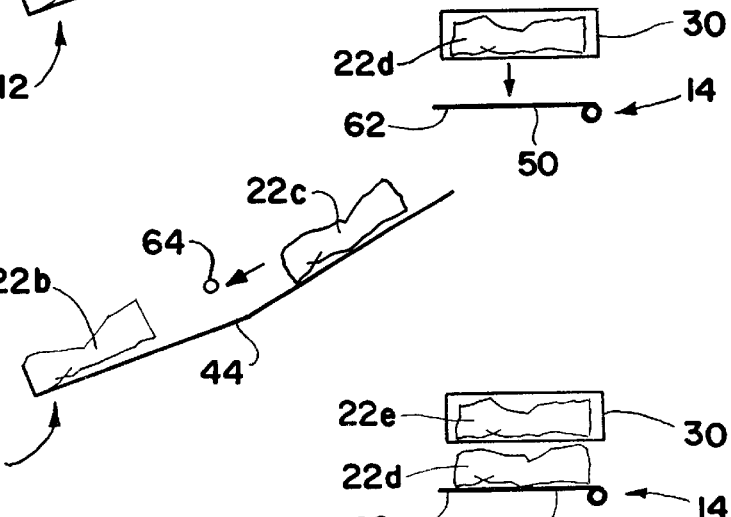

Referring to FIG. 3C, the pad support 50 is returned to its horizontal, or pad receiving, position, readying the pad support 50 for receiving the dunnage pad 22*d* thereon, a predetermined amount of time after the dunnage pad 22*c* is discharged therefrom sufficient to enable the dunnage pad 22*c* to clear the distal end 62 of the pad support 50. Although not shown, a pad support sensor may be employed, for example underneath the pad support 50, to detect that a dunnage pad 22, and in this instance the dunnage pad 22*c*, has cleared the pad support 50. Then, if the pad support sensor detects that there is no dunnage pad on the pad support 50, the pad support may be returned by the actuator 54 to its horizontal pad receiving position.

Figure 3D:
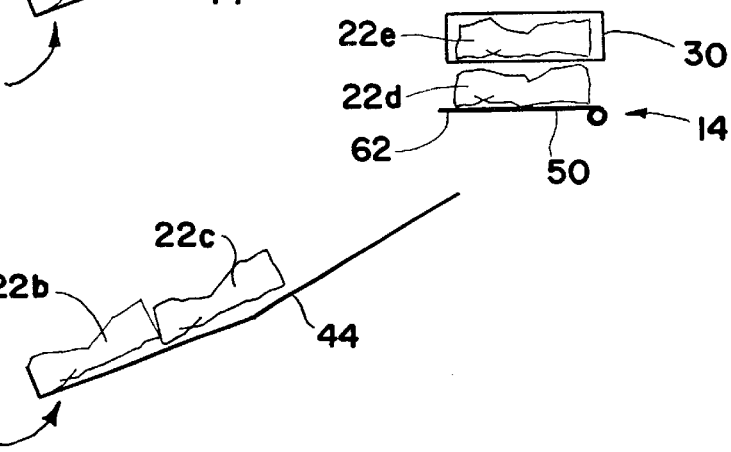

After, or while, the pad support 50 returns to its pad receiving position, the conversion machine 11 is instructed to produce a new dunnage pad 22*e* (not shown in FIG. 3C). When the new dunnage pad 22*e* is completed and is discharged by the conversion machine 11, the new dunnage pad 22*e* pushes the dunnage pad 22*d* then occupying the discharge chute 30 from the discharge chute 30 to deposit dunnage pad 22*d* onto the pad support 50. Thus, as is seen in FIG. 3D, the dunnage pad 22*d* falls by gravity onto the pad support 50, clearing itself from the new (i.e., the succeeding) dunnage pad 22*e*, which now occupies the discharge chute 30. The pad sensor 64 detects the presence of the dunnage pad 22*c* in the second pad position and, accordingly, the controller 25 places the conversion machine 11 in standby mode or otherwise stops the conversion machine 11.

Preferably, the pad support 50 is disposed in its inclined, discharge position as a fail safe position should the dunnage pad transfer mechanism 14 fail. This will enable the conversion machine 11 to continue discharging dunnage pads onto the slide 12 via the inclined pad support 50.

Also, it will be appreciated that the discharge chute 30 of the illustrated conversion machine 11 may be omitted and the dunnage pad transfer mechanism 14 positioned adjacent the exit opening 28 of the conversion machine 11. With such an alternative embodiment, the dunnage pad 22 will be deposited directly onto the pad support 50 when a dunnage pad 22 is discharged from the machine 11.

It will also be appreciated that the dunnage pad 22 may be discharged by the dunnage pad transfer mechanism 14 by gravity as shown or by power assist. To discharge by gravity force, the top surface of the pad support 50 must be such that the dunnage pads 22 will slide substantially frictionlessly down the top surface when the pad support 50 is in its inclined position. Alternatively or additionally, the dunnage pad transfer mechanism 14 may be equipped with a power assist mechanism to assist in advancing the dunnage pads 22 down the slide 12.

Figure 4:
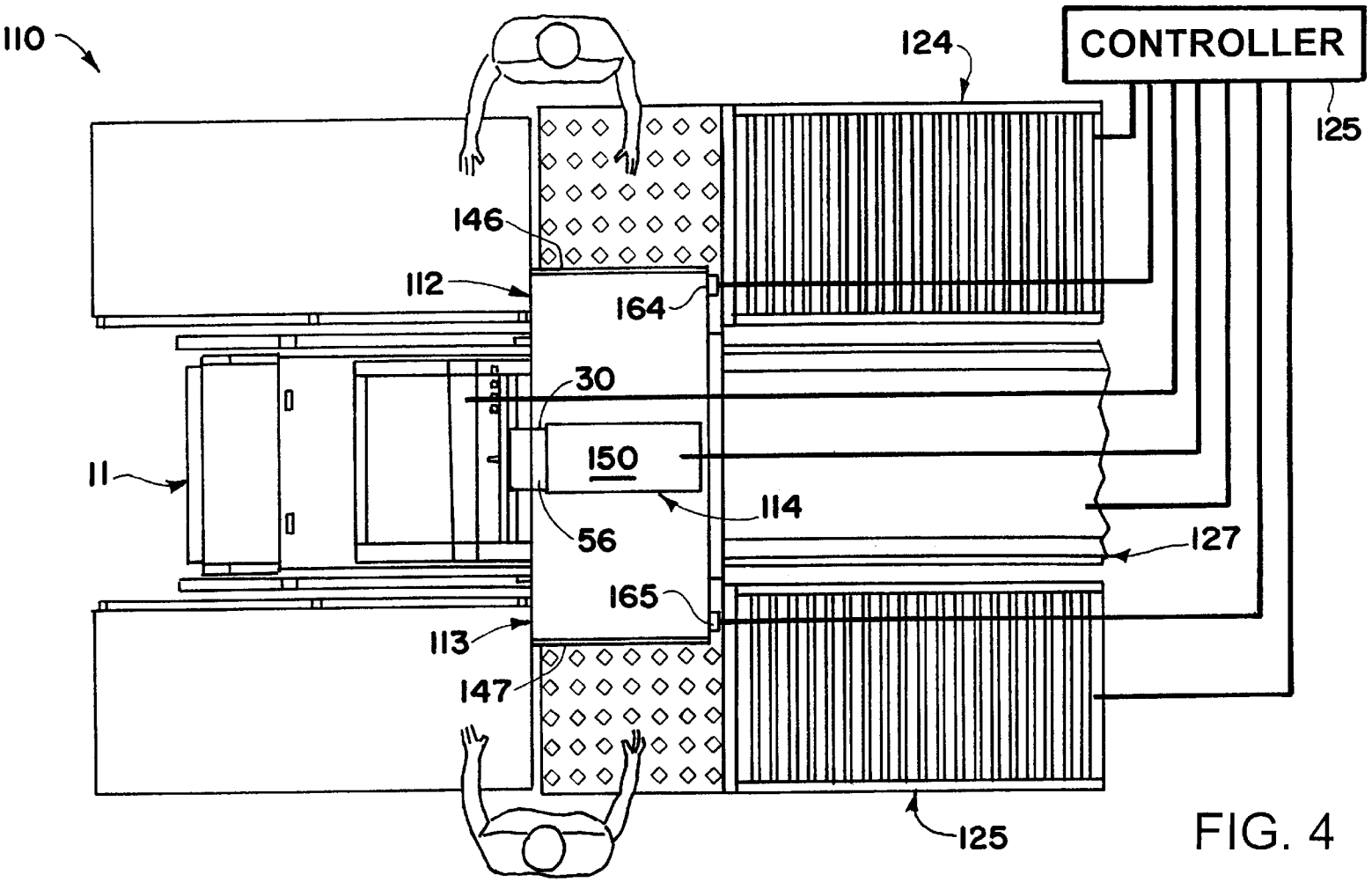
FIG. 4 is a top view of another packaging system according to the present invention, the system including a conversion machine and another embodiment of dunnage pad transfer mechanism which supplies dunnage pads to plural transitional members, such as slides associated with respective ones of plural packing stations.
Figure 5:
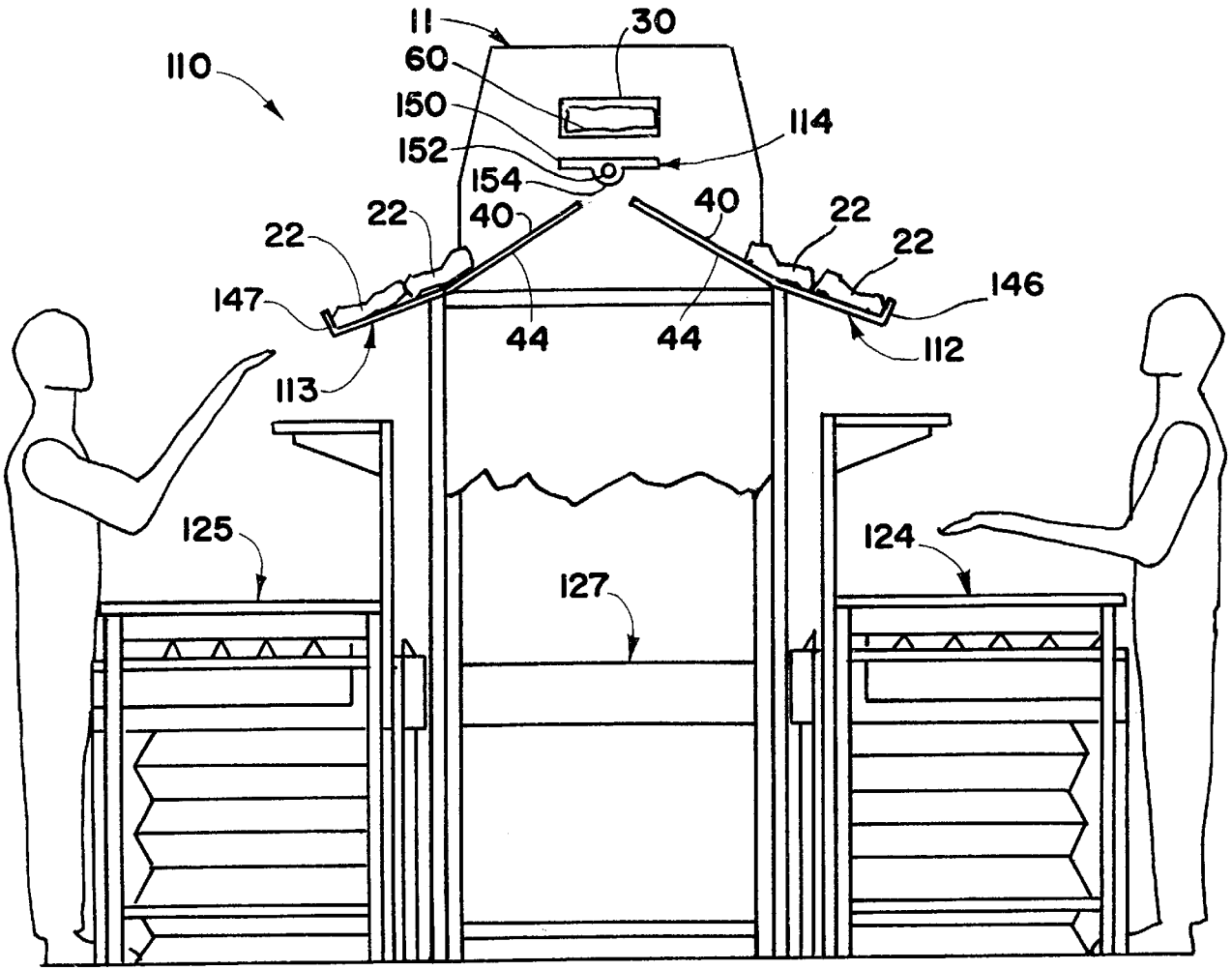
FIG. 5 is an end view of the packaging system of FIG. 4.

Referring now to FIGS. 4 and 5, another embodiment of a packaging system according to the invention is indicated generally at reference numeral 110. In the several figures, like reference numerals correspond to like components.

The packaging system 110 is similar to the afore described packaging system 10 shown in FIGS. 1 and 2, except that it includes a pair of transitional members 112 and 113 (for example, a pair of slides) positioned at opposite sides of the cushioning conversion machine 11, and a dunnage pad transfer mechanism 114 which transfers a dunnage pad 22 produced by the conversion machine 11 to either slide 112 and 113 in a controlled manner. Thus, the dunnage pad transfer mechanism 114 receives the dunnage pad 22 from the conversion machine 11 in a discharge direction D and subsequently discharges the dunnage pad 22 onto either the slide 112 in a first slide direction S1 or the slide 113 in a second slide direction S2, respectively (FIG. 4).

As is further seen in FIG. 4, the packaging system 110 may also include infeed container conveyors 124 and 125 which convey containers C (not shown) in the position below the bottom portions of the respective slides 112 and 113, enabling operators stationed at the respective conveyors 124 and 125 to pick a dunnage pad 22 from the respective slide 112 and 113 and place the dunnage pad 22 into a container C. An outfeed conveyor 127 may also be employed to convey containers C away from the operators' work stations, and a pair of work tables 129 and 131 may be provided for the product or products to be packed, and/or for side jobs, miscellaneous supplies, or the like. Also, like the afore described packaging system 10, a controller 125 (shown in FIG. 1 only) may be provided to control the packaging system 110.

Unlike the pad support 50 of the dunnage pad transfer mechanism 14, the pad support 150 of the dunnage pad transfer mechanism 114 is mounted for tilting movement between two oppositely disposed inclined discharge positions from an intermediate pad receiving position. In the illustrated embodiment, the pad support 150 is mounted to a pivot shaft 152, and an actuator 154 is provided to rotate the pivot shaft, or to pivot the pad support 150 about the pivot shaft 152. Other mounting and actuating means may be employed as desired.

The operation of the conversion machine 11 and the transfer mechanism 114 is coordinated by the controller 125, although it will be appreciated that the components may be controlled manually and/or independently of each other. The controller 125 is in communication with a pair of pad sensors 164 and 165 (FIG. 4) which are positioned and function in a manner similar to the afore described sensor 64; that is, the pad sensors 164 and 165 detect whether there is a dunnage pad 22 on the respective slide 112 and 113 two pads up from the respective end walls 146 and 147 thereof (i.e., "the second pad position"). After a pad is produced by the conversion machine, the pad support will tilt in the direction of the slide that needs to be replenished.

The manner by which a dunnage pad 22 is transferred by the dunnage pad transfer mechanism 114 from the conversion machine 11 to a slide 112 and 113 is essentially the same as that of the previously described pad transfer mechanism 14 in reference to FIGS. 3A–3D, except that the pad support 150 of the transfer mechanism 114 may be tilted to either of two pad discharge positions; that is, towards the slide 112 or the slide 113. Thus, if either of the pad sensors 164 or 165 detects the absence of a dunnage pad 22 in the respective second positions 146 and 147, then the dunnage pad transfer mechanism 114 is instructed via the controller 125 to discharge a dunnage pad 22 to the respective slides 112 and 113.

The particular order in which the transfer mechanism 114 discharges pads to the respective slides 112 and 113 may be based on any suitable criteria. For example, the dunnage pad transfer mechanism 114 may discharge dunnage pads in an alternating fashion to the respective slides 112 and 113, or in the order in which the respective sensors 164 and 165 detect the absence of a dunnage pad 22 in the respective second positions 146 and 147. As yet another alternative, the transfer mechanism 114 may discharge two dunnage pads to the slide 112 for every one dunnage pad discharged to the slide 113, or vice versa.

In any event, if both pad sensors 164 and 165 detect the presence of a dunnage pad in the respective second pad positions, then the controller 125 places the conversion machine 11 in standby mode or otherwise stops the conversion machine 11.

It is noted that the fail-safe position of the pad support 150 may be in an inclined position towards the slide 112 or the slide 113. In this way, if the dunnage pad transfer mechanism 114 fails, for example, as mentioned above, then the pad support 150 defaults to its inclined position, enabling the conversion machine 11 to continue discharging dunnage pads onto one of the slides 112 or 113 via the inclined pad support 150. Also, or alternatively, the pad support 150 may be removable so that dunnage pads are discharged directly onto either of the slides 112 or 113. Although not shown, the slides 112 and 113 may be equipped, either together or individually, with side rails to enable the slides 112 and 113 to be selectively slid under the discharge chute 30.

It will be appreciated that the packaging system 110 advantageously enables a single conversion machine 11 to provide dunnage pads 22 to two work stations. Since two operators work off the same conversion machine 11, the conversion machine 11 will not be in standby mode or otherwise stopped as often as if the conversion machine 11 were producing dunnage pads 22 for only one work station, as is the case with the afore described packaging system 10. Consequently, output and efficiency are improved by the packaging system 110.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion system, comprising:

a cushioning conversion machine for producing cushioning dunnage pads and discharging the pads in a predetermined discharge direction;

a pad support movable between a pad receiving position, whereat the pad support is oriented relative to the conversion machine to receive thereon dunnage pads discharged from the conversion machine in the discharge direction, and at least one pad discharge position, whereat the pad support is tilted relative to horizontal for discharge of the dunnage pad; and a sloped surface onto which the dunnage pad is discharged from the pad support when the pad support moves to its pad discharge position.

2. A cushioning conversion system as set forth in claim 1, wherein when the pad support moves to its pad discharge position, the dunnage pad is discharged in a slide direction from the pad support, and wherein the sloped surface is oriented relative to the conversion machine so that the slide direction is substantially perpendicular to the discharge direction.

3. A cushioning conversion system as set forth in claim 1, wherein the sloped surface is substantially parallel to the discharge direction.

4. A cushioning conversion system as set forth in claim 1, wherein when the pad support moves to its pad discharge position, the dunnage pad is discharged in a slide direction from the pad support, and further including a stop projecting from the sloped surface against which a dunnage pad moving in the slide direction along the sloped surface stops.

5. A cushioning conversion system as set forth in claim 1, wherein when the pad support is in its pad discharge position, the pad support is substantially parallel to the sloped surface.

6. A cushioning conversion system as set forth in claim 1, wherein the conversion machine includes a discharge chute from which the dunnage pad is discharged, and the pad support is oriented relative to the conversion machine such that when the pad support is in its pad receiving position the pad support lies in a plane substantially parallel to a bottom wall of the discharge chute.

7. A cushioning conversion system as set forth in claim 6, wherein the pad support, when it is in its pad receiving position, is offset from the bottom wall of the discharge chute.

8. A cushioning conversion system as set forth in claim 1, further including a controller for coordinating the operation of the pad support and conversion machine, and a pad sensor oriented relative to the sloped surface for detecting whether there is a dunnage pad at a predetermined location on the sloped surface.

9. A cushioning conversion system as set forth in claim 1, further including a pad support sensor for detecting whether there is a dunnage pad on the pad support.

10. A cushioning conversion system, comprising:

a cushioning conversion machine for producing cushioning dunnage pads and discharging the pads in a predetermined discharge direction;

a pad support movable between a pad receiving position, whereat the pad support is oriented relative to the conversion machine to receive thereon dunnage pads discharged from the conversion machine in the discharge direction, and one of either first or second pad discharge positions whereat the pad support is tilted relative to horizontal for discharge of the dunnage pad from the pad support; and first and second sloped surfaces positioned at opposite sides of the pad support, wherein when the pad support is tilted to its first discharge position the dunnage pad is discharged in a first slide direction onto the first sloped surface, and wherein when the pad support is tilted to its second discharge position the dunnage pad is discharged in a second slide direction onto the second sloped surface.

11. A cushioning conversion system as set forth in claim 10, wherein the pad receiving position is disposed intermediate the pair of discharge positions.

12. A cushioning conversion system as set forth in claim 10, wherein the first and second sloped surfaces are oriented relative to the conversion machine so that the respective first and second slide directions are substantially perpendicular to the discharge direction.

13. A method of providing a dunnage pad onto one of first and second sloped transitional surfaces, comprising the steps of:

using a cushioning conversion machine to convert sheet stock material into a dunnage pad;

discharging the dunnage pad from the conversion machine onto a pad support, the pad support being positioned in a pad receiving position; and, tilting the pad support from the pad receiving position to either a first pad discharge position to discharge the dunnage pad therefrom and onto the first transitional surface or to a second pad discharge position to discharge the pad therefrom and onto the second transitional surface.

14. A method as set forth in claim 13, wherein the step of discharging the dunnage pad from the conversion machine includes using the cushioning conversion machine to convert sheet stock material into a succeeding dunnage pad, and using the succeeding dunnage pad to push the existing dunnage pad from the conversion machine onto the pad support.

15. A method as set forth in claim 14, further including maintaining at least a portion of the existing dunnage pad in a discharge chute of the conversion machine for a predetermined amount of time until the succeeding dunnage pad pushes the dunnage pad out from the discharge chute.

16. A method as set forth in claim 13, repeating the steps to form a succeeding dunnage pad, the succeeding pad, when discharged onto either the first or second transitional surface, stacking in a side-by-side manner with an existing dunnage pad on the respective first or second transitional surface.

17. A method as set forth in claim 13, wherein after the step of tilting the pad support to discharge the dunnage pad therefrom, the pad support is tilted back to the pad receiving position to receive a succeeding dunnage pad from the conversion machine.

18. A method as set forth in claim 17, wherein after the pad support is tilted to receive the succeeding dunnage pad, the step of using the conversion machine is repeated.

19. A method as set forth in claim 17, wherein while the pad support is tilted to receive the succeeding dunnage pad, the step of using the conversion machine is repeated.

20. A method as set forth in claim 13, wherein after the step of tilting the pad support to discharge the dunnage pad therefrom, tilting the pad support back to the pad receiving position to receive a succeeding dunnage pad from the conversion machine and then tilting the pad support to either the first pad discharge position to discharge the succeeding dunnage pad therefrom and onto the first transitional surface or to the second transitional surface to discharge the succeeding dunnage pad therefrom and onto the second transitional surface.

21. A method as set forth in claim 20, wherein the pad support is tilted to the first discharge position both to discharge the dunnage pad therefrom and to discharge the succeeding dunnage pad therefrom.

22. A method as set forth in claim 20, wherein the pad support is tilted to the first discharge position to discharge the dunnage pad therefrom and then to the second discharge position to discharge the succeeding dunnage pad therefrom.

23. A method as set forth in claim 20, wherein for every one dunnage pad that the pad support discharges to the first transitional surface, the pad support discharges two or more dunnage pads to the second transitional surface.

24. A method as set forth in claim 20, further including detecting whether there is an existing dunnage pad at a predetermined location on the first transitional surface or at a predetermined location on the second transitional surface.

25. A method as set forth in claim 24, wherein if no dunnage pad is detected at the predetermined location on the first transitional surface, then the pad support is tilted to the first discharge position to discharge the dunnage pad therefrom and onto the first transitional surface.

26. A method as set forth in claim 24, further including stopping the conversion machine if there is detected an existing dunnage pad at the predetermined location on the first transitional surface and an existing dunnage pad at the predetermined location on the second transitional surface.

27. A dunnage pad transfer mechanism for positioning at the outlet of a cushioning conversion machine, comprising a pad support movable between a pad receiving position and either a first pad discharge position or a second pad discharge position, and first and second transitional slides adjacent the pad support for receiving a pad therefrom when the pad support is tilted from its pad receiving position to the respective first or second pad discharge position.

* * * * *